US006814759B2

(12) United States Patent
Larsen et al.

(10) Patent No.: US 6,814,759 B2
(45) Date of Patent: Nov. 9, 2004

(54) STABLE ZEOLITE/CELLULOSE COMPOSITE MATERIALS AND METHOD OF PREPARATION

(75) Inventors: Gustavo Larsen, Lincoln, NE (US); David Vu, Lincoln, NE (US); Manuel Marquez-Sanchez, Glenview, IL (US)

(73) Assignees: Board of Regents of the University of Nebraska, Lincoln, NE (US); Kraft Foods Inc., Northfield, IL (US)

( * ) Notice: Subject to any disclaimer, the term of this patent is extended or adjusted under 35 U.S.C. 154(b) by 0 days.

(21) Appl. No.: 10/212,909

(22) Filed: Aug. 6, 2002

(65) Prior Publication Data

US 2004/0028900 A1 Feb. 12, 2004

(51) Int. Cl.[7] ..... D06M 11/38; D21C 3/02

(52) U.S. Cl. ..... 8/125; 8/115.51; 162/90; 162/91; 162/100; 162/109; 428/393

(58) Field of Search ..... 8/125, 115.51; 428/393; 162/90, 91, 92, 100, 109

(56) References Cited

U.S. PATENT DOCUMENTS

| | | | | |
|---|---|---|---|---|
| 3,327,718 A | | 6/1967 | Kilburn | |
| 4,572,742 A | | 2/1986 | Kunin et al. | |
| 4,735,193 A | | 4/1988 | Kulprathipanja et al. | |
| 5,122,407 A | | 6/1992 | Yeo et al. | |
| 5,603,830 A | | 2/1997 | Everhart et al. | |
| 5,728,634 A | | 3/1998 | Everhart et al. | |
| 5,858,021 A | * | 1/1999 | Sun et al. | 8/125 |
| 5,906,743 A | | 5/1999 | Cohen et al. | |

FOREIGN PATENT DOCUMENTS

| | | |
|---|---|---|
| EP | 1 061 124 A1 | 12/2000 |
| JP | 55160035 | 12/1980 |
| JP | 63035886 | 2/1988 |
| JP | 63224734 | 9/1988 |
| JP | 2000189793 | 11/2000 |
| RU | 2109767 | 4/1997 |

OTHER PUBLICATIONS

Duval, J.M. et al., "Adsorbent Filled Membranes for Gas Separation. Part 1. Improvement of the Gas Separation Properties of Polymeric Membranes by Incorporation Adsorbents", Journal of Membrane Science, (1993), pp 189–198, vol. 80.

(List continued on next page.)

*Primary Examiner*—Cynthia H. Kelly
*Assistant Examiner*—J. M. Gray
(74) *Attorney, Agent, or Firm*—Suiter West PC LLO

(57) ABSTRACT

Stable cellulosic fiber material for use in forming zeolite/cellulose composites is prepared by suspending loose cellulose fibers in an aqueous solution of sodium hydroxide, potassium hydroxide or sodium silicate, stirring the resulting suspension until it reaches a macroscopically homogenous appearance, heating the resulting mixture at a temperature of 323–423 K until only dry solids remain, contacting the resulting mixture with excess distilled water to remove physically adsorbed or trapped sodium hydroxide, potassium hydroxide or sodium silicate from the fibers, and heating the resulting fiber material at 323–423 K to dry the fiber material. Stable zeolite/cellulose composite material characterized in that leaching of the zeolite phase does not occur upon contact of the composite with water at approximately 373 K comprises a zeolite and a stable cellulosic fiber prepared as described above, the composite material being formed by contacting a zeolite with the stable fiber material.

6 Claims, 9 Drawing Sheets

OTHER PUBLICATIONS

Huang, T.J. et al., "Reprints/Division of Petroleum Chemistry, American Chemical Society", American Chemical Society Division of Petroleum Chemistry, (2001), pp 166–167, vol. 46, No. 2.

Mintova, S. et al., "Deposition of Zeolite A on Vegetal Fibers", Zeolites: The International Journal of Molecular Sieves, (1996), pp. 31–34, vol. 16.

Mintova, S. et al., "Preparation of Zeolite Covered Cellulose Fibers", Abstracts of Papers—290th ACS National Meeting, American Chemical Society, 1995.

Mizukami, F., "Preparation of Zeolite Membranes and Their Applications", Hyaomen Kagaku=Journal of the Surface Science Society of Japan, (1998), pp 658–664, vol. 19, No. 10.

Nikawa, H. et al., "Antifungal Effect of Zeolite–Incorporated Tissue Conditioner Against *Candida Albicans* Growth and/or Acid Production", Journal of Oral Rehabilitation, (1997), pp 350–357, vol. 24.

Sano, T. et al., "Preparation of Zeolite Film Using Cellulose Moulding", Proceedings from the Ninth International Zeolite Conference, (1993), pp 239–246, vol. 1.

Zeni, M. et al., "Photosynthetic Membranes. VI. Characterization of Ultrafiltration Membranes Prepared by Photografting Zeolite–Epoxy–Diacrylate Resin Composites onto Cellulose", Journal of Membrane Science, (1988), pp 277–275, vol. 36.

* cited by examiner

STABLE ZEOLITE/CELLULOSE COMPOSITE MATERIALS AND METHOD OF PREPARATION

BACKGROUND OF THE INVENTION

This invention relates to stable zeolite/cellulose composite materials and, more particularly, to a general, facile method for preparing such composite materials.

Synthetic and natural zeolites, a family of aluminosilicates with pores and cavities in the range 4–18 Å, are well known heterogeneous catalysts and absorbents. The preparation of a soft membrane with molecular sieving properties is attractive from both practical and fundamental standpoints. One general approach is to combine a crystalline, yet porous solid such as zeolites, with a flexible, cheap and abundant organic matrix, such as natural cellulose [S. Mintova, V. Valtchev, Zeolites 16 (1996), 31]. Once a stable zeolite/cellulose material is synthesized, carton- or paper-like zeolite/cellulose filters can be produced by contacting the composite with distilled water to incipient wetness, followed by applying pressure to 2–5 ton/cm$^2$ at 383 K for a few minutes. A porous zeolite/cellulose filter paper manufactured this way will have molecular sieving properties, and as such, having some degree of perm-selectivity makes it a membrane by definition.

Zeolite/cellulose and cellulose acetate composites have already been proposed for numerous uses. For example, they have been tested for medical applications (medical antibacterial materials, denture plaque control (H. Nikawa et al., J. of Oral Rehabilitation 24 (1997) 350]), fragrance products (tissue conditioner [H. Nikawa et al. supra]), fabric softeners (T. McGee et al. EP Pat. 1,061,124, 2000) deodorizers (removal of $NH_3$, $H_2S$ [H. Haruhito et al., JP Pat. 63,224,734 (1988)] and $EtNH_2$ [Y. Takashi et al., JP Pat. 86,241,059 (1988)], and filtrations (ultrafiltration membrane [Z. Mara et al., J. Membr Sci. 36 (1988) 277], dewatering sludges [Y. Yoshiya et al., JP Pat. 84,158,863 (1986)], tobacco smoke filters [Keith, U.S. Pat. No. 3,327,718 (1967)], water purification [Katsumi et al., JP Pat. 92,286,299 (1994)], air purification [Norimitsu et al., JP Pat. 92,129,440 (1993)], filtration membranes for aerated water and wine [Kazusumi et al., JP Pat. 91,177,260 (1991)], and adsorbent filter for decaffeinating processes [Cohen et al., U.S. Pat. No. 5,906,743 (1999), Everhart et al., U.S. Pat. No. 5,603,830 (1997) and Everhart et al., U.S. Pat. No. 5,728,634 (1998)]. Other applications related to adsorption process have also been proposed. Among these are absorbent pads (antimicrobial water-absorbing sheet for food [Junichi et al., JP Pat. 110,032,748 (1999)], adsorbent sheets [Japan Vilene Co., JP Pat. 55,160,035 (1980)], disposable diapers, sanitary napkins, panty shields, underarm shields and incontinence pads [Yeo et al., U.S. Pat. No. 5,122,407 (1992)], gas and liquid separations ($CO_2/CH_4$, $O_2/N_2$ [Duval et al., J. Membr. Sci. 80 (1993), 189], olefin/paraffin [Huang et al., Prepr, ACS Div. Petr. Chem. 46 (2001), 166], monosaccharide/polysaccharide [Kulprathipanja et al., U.S. Pat. No. 4,735,193 (1985)], and refining processes (decoloration and decalcifying of sugar syrup [Kunin et al., U.S. Pat. No. 4,572,742 (1986)].

The prior art is that zeolite/cellulose composite materials can be prepared by using adhesive polymers [Korchakov et al., RU Pat. 2,109,767 (1988, Katsunao JP Pat. 2,000,189,793 (2000), M. Fujio, Hyoman Kagaku 19 (1998), 658, Sano et al., Proc. Int. Zeolite Conf. 9th (1993), 239–246) and Toshio et al. JP Pat. 63,035,886 (1998)], electret technology

[Cohen et al. U.S. Pat. No. 5,906,743 (1999)], or in situ zeolite crystallization [Mintova, Valtchev, Zeolites 16 (1996), 31, Mintova, Valtchev, Preparation of Zeolite-Covered Cellulose Fibers, 209th National Meeting Abstracts, American Chemical Society (1995), and Niu, "A Study on the Preparation of Zeolite Y-Cellulose Composite Materials, M.S. thesis (2000), University of Nebraska-Lincoln]. As to the last strategy, it has been noted that untreated cellulose fibers have a marked tendency, at different temperatures and Si/Al starting ratios, to induce crystallization of zeolite 5A particles on their surface [Niu, supra]. The sparse work reported in the open literature on in situ zeolite crystallization over cellulose revolves around 5A/cellulose composites. (See Mintova and Valtchev supra).

The adhesive polymer method was used in industry for several decades. Mintova and Valtchev (supra) indicated that there were several disadvantages associated with this process, the most important ones being the weak zeolite/cellulose interaction, and the uneven distribution of zeolite crystallites on the cellulose surface. In addition, incorporating an adhesive (a third chemical entity) in the zeolite/cellulose composite might be deemed unacceptable for certain applications, especially if the polymer is unstable or soluble in the filtration medium. The so-called "electret" method requires the use of high voltages, which might damage substances and poses an occupational risk. The third synthetic approach normally yields by-products and materials that are unstable on washing with boiling water. (Niu, supra).

There remains a need for a method of preparing zeolite/cellulose composite materials which is easy to carry out and which produces composite materials stable upon prolonged boiling water washing.

SUMMARY OF THE INVENTION

Among the several objects of the invention may be noted the provision of a method for preparing stable cellulosic fiber material for use in forming zeolite/cellulose composites; the provision of such a method which may be readily carried out in a cost-effective manner; the provision of novel zeolite/cellulose composite materials in which the zeolite content is characterized by being stable on washing with water at 373 K for several hours; and the provision of zeolite/cellulose composite materials produced by a method which makes use of commercial zeolite powders and cellulose sources. Other objects and features will be in part apparent and in part pointed out hereinafter.

Briefly, the present invention is directed to the method of preparing stable cellulosic fiber material for use in forming zeolite/cellulose composites comprising the steps of (a) suspending loose cellulose fibers in an aqueous solution of sodium hydroxide, potassium hydroxide or sodium silicate; (b) stirring the resulting suspension until it reaches a macroscopically homogeneous appearance; (c) heating the resulting mixture at a temperature of approximately 323–423 K until only dry solids remain; (d) contacting the resulting mixture with excess distilled water to remove physically adsorbed or trapped compound of step (a) from the fibers; and (e) heating the resulting fiber material at a temperature of approximately 323–423 K to dry the fiber material. The invention is further directed to a stable zeolite/cellulose composite material characterized in that leaching of the zeolite phase of the composite does not occur upon contact of the composite with water at approximately 373 K, the composite material comprising a zeolite and a stable cellulosic fiber material prepared by the above-described method. The invention is also directed to the method of preparing a stable zeolite/cellulose composite material comprising the steps of preparing a stable cellulosic fiber material by the above-described method, contacting a zeolite with the stable cellulosic fiber material; stirring the resulting solid-liquid suspension until macroscopic homogeneity is achieve, heating the resulting composite material at a temperature of approximately 323–423 K, washing the resulting composite material, and drying the resulting composite material.

DESCRIPTION OF THE PREFERRED EMBODIMENTS

Figure 1A:
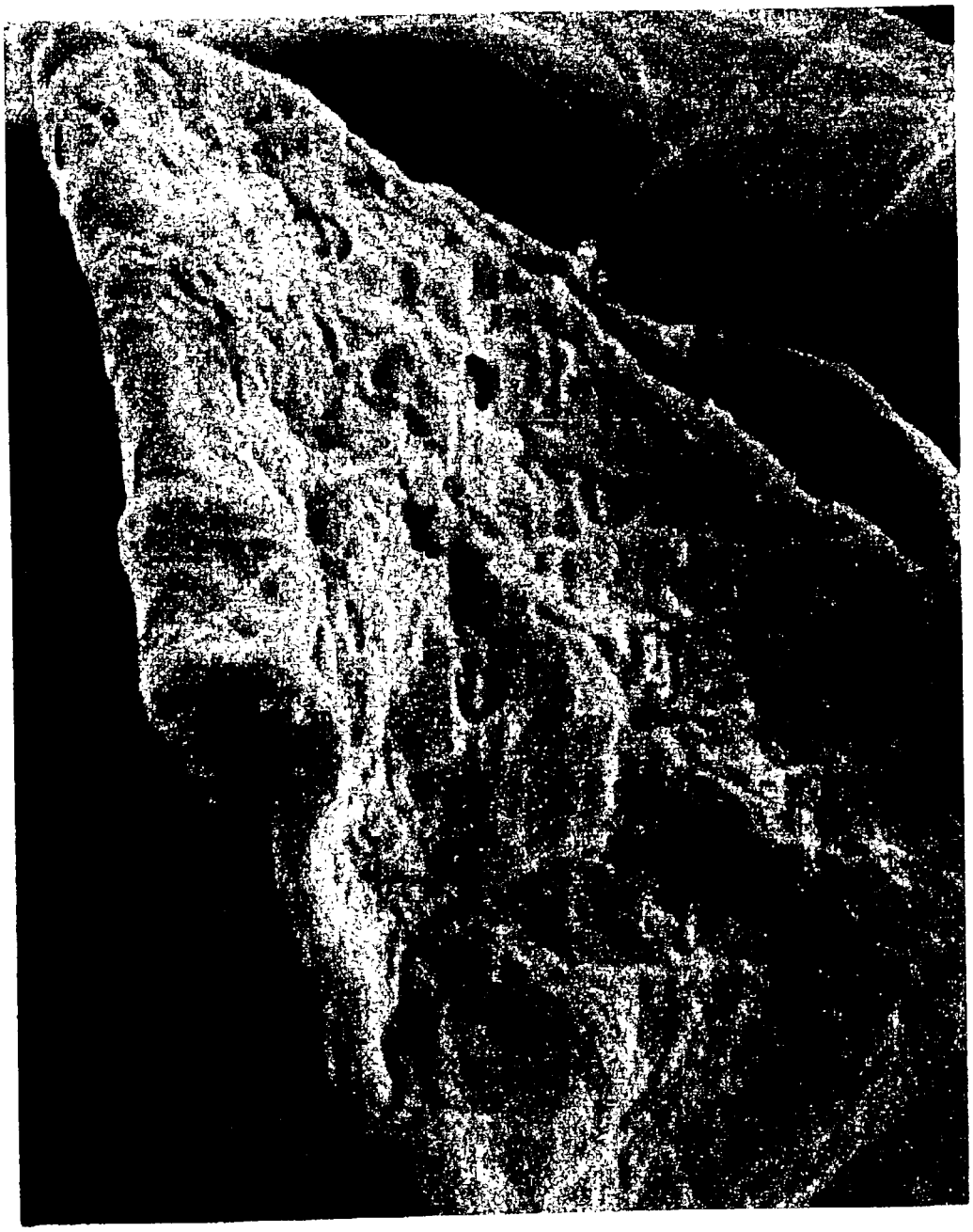
FIG. 1*a* is an SEM image of a NaOH-treated cellulose fiber after removal of reversibly adsorbed hydroxide with deionized water.

In accordance with the present invention, it has now been found that stable cellulosic fiber material for use in forming zeolite/cellulose composites can be readily and efficiently prepared by first suspending loose cellulose fibers in an aqueous solution of sodium hydroxide, potassium hydroxide or sodium silicate, stirring the suspension until it reaches a macroscopically homogeneous appearance, heating the resulting mixture at a temperature of approximately 323–423 K until only dry solids remain, contacting the resulting mixture with excess distilled water to remove physically adsorbed or trapped sodium hydroxide, potassium hydroxide or sodium silicate, and heating the resulting fiber material at a temperature of approximately 323–423 K to dry it. It has been found that the above-described cellulose fiber pre-treatment is essential to ultimately produce zeolite/cellulose composite materials that are stable in the presence of boiling water.

The cellulose fibers employed may be from various commercial sources such as bleached Kraft pulp, it being preferred that the cellulose have a lignin content of approximately 0.1%. The above-described method is carried out in a reactor, preferably an open reactor which has been found more effective. While the heating steps may be carried out at temperatures within the range 323 to 423 K, a temperature of approximately 373 K is preferred.

In further accordance with the invention, it has been found that stable zeolite/cellulose composite materials may be formed by contacting a zeolite with the stable cellulosic fiber material resulting from the above-described method, stirring the resulting solid-liquid suspension until macroscopic homogeneity is achieved, heating the resulting composite at a temperature of approximately 323 to 423 K, washing the composite with distilled water and drying the resulting composite. As used herein, the term "stable" means that the zeolite phase of the zeolite/cellulose composite so formed resists leaching on contact with water at 373 K, i.e. the composite is stable in boiling water. For use in the present invention, any commercial zeolite such as zeolite L or zeolite Y may be employed. For example, zeolite L available from Tosoh Corporation in its $K^+$ form and with a Si/Al ratio of 3 may be used. When zeolite L is used, it is preferred that potassium hydroxide be employed in the first step of the pre-treatment method described above. Typical zeolite loadings in the stable zeolite/cellulose composites of the invention fall in the 5 to 20% by weight range. In forming the zeolite/cellulose composite as described, the heating step may be carried out at a temperature within the range 323 to 423 K, with a temperature of 373 K being preferred.

In the first step of the above-described method, an aqueous solution of a compound selected from the group consisting of alkali metal and alkaline earth metal hydroxides and silicates such as sodium hydroxides and silicates such as sodium hydroxide, potassium hydroxide, calcium hydroxide, barium hydroxide, sodium silicate, potassium metasilicate, etc. In connection with this cellulose pretreatment, it is preferred to use either hydroxides or silicates with the same cations as those present in the zeolite to be mounted onto the cellulose. Thus, zeolite L is commercially available in its potassium form and potassium hydroxide or silicate should be used in the fiber pretreatment step. Similarly, zeolite Y is commercially available in its sodium form and sodium hydroxide or silicate should be used in the pretreatment step in loading zeolite Y. In preparing sodium hydroxide or sodium silicate-treated fiber, it must be carried out in an open container and the fiber color should change form white to light yellow.

In forming the composite zeolite/cellulose materials, it is preferred that the starting zeolite: cellulose ratios be between approximately 0.5 and 40, most preferably 6. Further, the starting zeolite: water ratio preferably ranges between approximately 0.1 and 4, most preferably 1.

The present invention thus provides an easy to use, cost-effective method for producing stable zeolite/cellulose composite materials useful in any applications where they are not subjected to conditions harsher than prolonged contact with boiling water. Once the composites of the invention are synthesized, carton or paper-like zeolite/cellulose filters can be produced by contacting the composite with distilled water to incipient wetness followed by applying pressure to 2–5 ton/cm$^2$ at approximately 383 K for a few minutes. The composites of the invention are thus adapted to be useful in the manufacture of filter paper which may be used for decaffeinating coffee during brewing or for the removal of a variety of harmful or undesirable molecules from edible liquids (liquid-phase adsorption) and solid food (gas-phase adsorption).

The following examples illustrate the practice of the invention:

EXAMPLE 1

Pretreatment of the Cellulose Fibers with NaOH (KOH or $Na_2SiO_3$

Sodium hydroxide (0.9 g, Mallinckrodt, Inc. 98+%) was dissolved in 40 mL of distilled water and placed in a 150 mL Teflon reactor (cylindrical, 2 in. ID, 2.5 in. OD). Subsequently, 4 g of loose cellulose fibers (Celect™ Bleached Kraft pulp from the Celgar Pulp Co., British Columbia, Canada) were suspended in this NaOH solution. The resulting suspension was stirred until it reached a macroscopically homogeneous appearance (approximately 5 min.). The loaded, open reactor was placed in an oven with forced air circulation at 373 K, and the mixture on the reactor was occasionally stirred during the first 4.5 hours, or just until the point at which only dry solids remained. The NaOH-cellulose solid mixture was then removed from the reactor and contacted with excess distilled water in a household blender. This vigorous "washing" cycle was intended to remove physically adsorbed or trapped NaOH from the fibers. The cellulose material was then rinsed to neutrality, and placed back in the oven at 373 K for another 24 hrs. Since this NaOH-treated cellulose precursor is freed from reversibly adsorbed hydroxide via thorough washing with distilled water, the action of NaOH is limited to attack of the cellulose surface and/or irreversible adsorption on the fibers. This precursor material was labeled as "NaOH Fiber". Identical fiber pretreatment experiments, using $Na_2SiO_3$ (pentahydrate, Fluka, 97%) and KOH (Aldrich, semiconductor grade, 99.99%), were conducted. After extensive experimentation, such fiber pre-treatment approach was found to be essential to ultimately produce zeolite/cellulose materials that are stable in the presence of boiling water. It should also be noted that the commercial source of cellulose utilized in this study has a very low lignin content (approximately 0.1% according to the manufacturer). Lignin has been shown to adversely affect zeolite deposition on cellulose during zeolite in situ crystallization [S. Mintova, V. Valtchev, Zeolites 16 (1996) 31; and S. Mintova, V. Valtchev, Preparation of Zeolite-Covered Cellulose Fibers, 209th National Meeting Abstracts, American Chemical Society, 1995). On prolonged drying (>1 day) at 473 K, slow "browning" of the material is observed, which suggests that cellulose dehydroxylation imposes an upper temperature bound for utilization of these materials.

EXAMPLE 2

Zeolite Deposition

In the same Teflon reactor as the one used in Example 1, a suspension of 12 mL of distilled water and 12 g of zeolite Y (sodium form, Si/Al=5, Aldrich) was placed and contacted with 1.92 g of NaOH-Fiber (KOH-Fiber, or $Na_2SiO_3$-Fiber). This solid-liquid suspension was stirred for 15 minutes, until it achieved macroscopic homogeneity. After that, the loaded reactor was placed in the oven with (or without) a screw-on cap with an O-ring seal at 373 K for 24 hrs. The resulting zeolite Y/cellulose mass was washed with distilled water many times to pH 6.5–7.0, and finally oven dried at 373 K for 24 hrs. This cold-water washing process, while tedious, also allows for the separation of the zeolite that has not attached to the cellulose, since the former tends to settle at the bottom of the washing container in every washing step. By subsequently washing the material for several hours in boiling water, the zeolite weight eventually stabilizes. While physical retention of a small fraction of colloidal zeolite particles cannot be entirely ruled out, the materials stabilized by hours of washing in boiling water will remain stable from a practical viewpoint. Blank experiments using untreated cellulose, water and zeolites following exactly the same cold-water/hot-water washing protocol showed that no irreversible deposition of zeolite onto cellulose was achieved.

The procedure described above is optimum for zeolite Y/cellulose products. Upon extensive experimentation, it was found that zeolite L/cellulose composites are better produced by KOH activation of the fibers, instead of NaOH. Zeolite L was purchased from Tosoh Corporation in its $K^+$ form and with a Si/Al ratio of 3. In both cases, (Y- and L-loaded fibers), several experiments were run with closed or open reactors, the latter being much more effective. Prior to zeolite loading and after through washing with deionized water, the NaOH-(KOH or $Na_2SiO_3$) treated fibers were also characterized.

EXAMPLE 3

To study the stability of the zeolite deposits in the presence of boiling water, several washing experiments were carried out. Typically, 0.3 g of zeolite-loaded sample were contacted with 100 mL deionized water, and the resulting suspension was placed in an air-tight PVC container. The PVC bottles were then put in an oven at 373 K for different periods of time (0.5, 1, 2, 4, and 8 hrs.). After that, the zeolite fibers were filtered and washed several times with distilled water. These zeolite-loaded fibers were finally oven-dried at 373 K for 24 hrs. Since the occurrence of a zeolite crystallite anchoring mechanism involving basic surface sites was suspected, the stability of zeolite/fiber materials was also tested by acid attack with 0.1% (w/w) HCl. It was found that these composites, which were shown to be stable after water washing at 373 K for several hours, undergo quantitative removal of the zeolite coating on contact with dilute HCl.

Since the best results were obtained using open reactors, conducting water evaporation loss experiments became necessary. Five reactors were loaded with reactants as described above and placed simultaneously in the oven at 373 K with forced air circulation. At a chosen time, all five reactors, were then taken out of the oven, and their water losses recorded by weight difference. This provides one water loss data point that is actually an average of five measurements. The same procedure was repeated using different times, until no mass change in the reactors was apparent.

Characterization Methods

X-ray diffraction using a Rigaku DMAX/IIB diffractometer with Cu K-α radiation was used as a rapid, qualitative tool to determine whether stable zeolite loadings were achieved on prolonged washing with boiling water. The spectra were recorded in the 2θ=2–35° range, scanning at a rate of 2°/min. for zeolite identification purposes and in the 2θ=2–19° window at a 1°/min. rate for quantification purposes. The step size was 0.02°.

Scanning electron microscopy studies were done in the bright field mode with a JEOL MEM2010 instrument at 200 keV beam energy. The sample was coated with a thin film of gold using a standard SEM specimen handling protocol to improve the quality of the image since the zeolite fibers are non-conducting.

The IR studies were carried out at room temperature on a Nicolet 20 SXB Fourier transform infrared spectrometer equipped with an optical and temperature control system, and DRIFTS cell from Spectratech®. Spectral resolution was 4 $cm^{-1}$.

On washing the zeolite-loaded fibers with boiling water, BET specific surface area measurements were conducted in a custom-built glass system, equipped with greaseless 3-O-ring stopcocks, mechanical and diffusion pumps, and a Baratron® pressure transducer. Prior to nitrogen adsorption measurements, samples were heated from room temperature to 383 K for 30 min., and then kept at the same temperature for 1 hr. under vacuum to remove adsorbed moisture. The main goal of the adsorption experiments is to complement XRD data on the issue of zeolite removal by prolonged exposure to water at 373 K.

Results

Figure 1B:
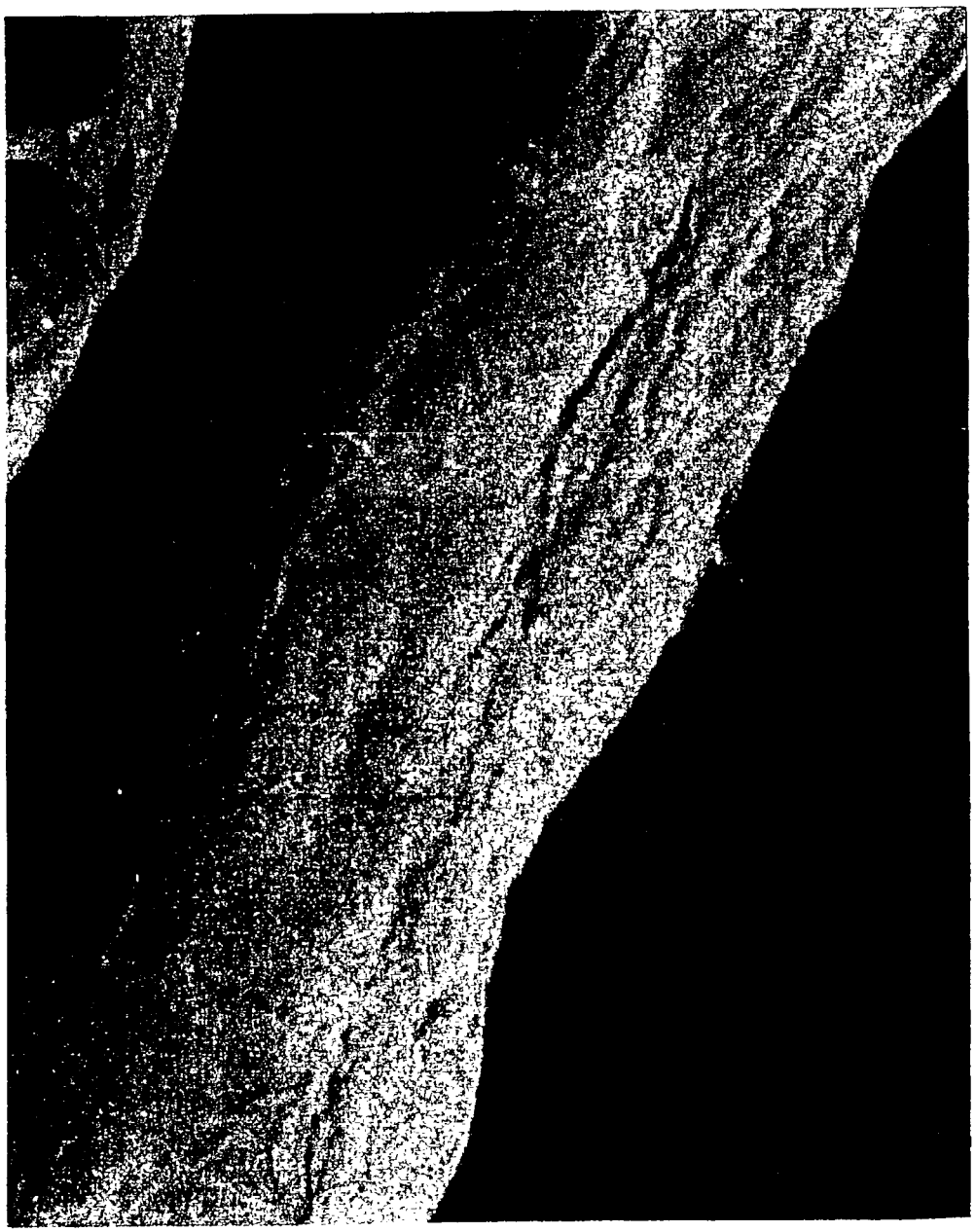
FIG. 1*b* shows untreated cellulose fiber.

By means of DRIFTS, it was confirmed that fiber pretreatment does not appear to affect the bulk chemical properties of the fibers. However, their surface was clearly affected by NaOH or $Na_2SiO_3$. FIG. 1A shows a SEM image of the NaOH-treated cellulose substrate. Crater-like holes are created, a feature that is clearly absent in untreated fibers (FIG. 1B). Treatment with $Na_2SiO_3$ was also found to promote surface roughness in the cellulose substrate (not shown). Fibers from the source used in this study like the one shown in FIG. 1 were found to have diameters around 20–60 $\mu$m. The full width of the images in FIG. 1 is 60 $\mu$m.

The surface morphology changes observed on NaOH treatment are expected to be accompanied by some level of chemical modification of the surface. Cellulose is in essence a natural carbohydrate-based polymer and a polyvalent alcohol, where the free hydroxy group in its monomeric units form hydrogen bonds with adjacent chains [L. T. Fan, L. M. Gharpuray and Y. H. Lee "Cellulose Hydrolysis", S. Aiba et al. Eds. Biotechnology Monographs, Springer-Verlag, Berlin, Vol. 3, p. 60, 1987]. In addition, the proposal that hydroxyl groups in oligomeric silicates can disrupt the inter-chain hydrogen bonds in cellulose, was first made by Mintova and Valtchev [supra 1995]. Damage of the cellulose surface to the extent shown in FIG. 1 is expected to go beyond NaOH interaction with the exposed —OH groups at the surface of the fibers. Instead, such interaction should either thoroughly disrupt the hydrogen bonding mechanism between adjacent polymer chains, or even partially hydrolyze the polymer structure. For example, the use of diluted NaOH has long been known to promote swelling and digestibility of lignocellulosic materials [K. Niu, "A study on the Preparation of Zeolite Y-Cellulose Composite Materials", M.S. Thesis (2000), University of Nebraska-Lincoln]. Specific surface area analysis showed that the available surface of the fibers increases from 23 $m^2/g$ to 30 $m^2/g$ after NaOH treatment, and to 26 and 41 $m^2/g$ after KOH and $Na_2SiO_3$ attack, respectively. In addition to cellulose surface activation, the presence of water will play a crucial role.

Figure 2:
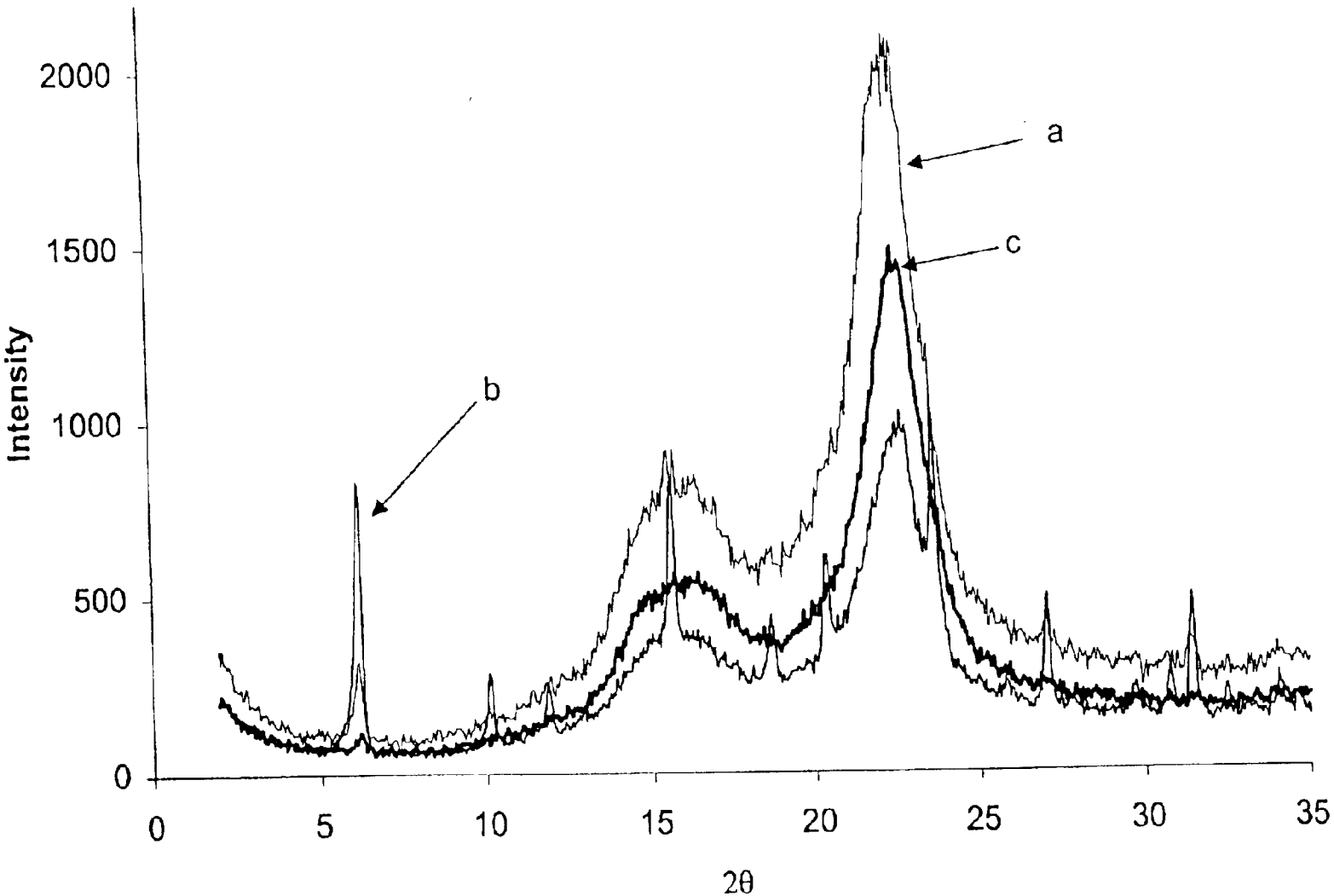
FIG. 2 is a graph showing NaOH-treated fiber loaded with zeolite Y, a) 14 hrs. reaction time ("fresh" sample, only rinsed with cold water); b) 24 hrs. reaction time (only rinsed with cold water after reaction), and c) without water (solid/solid reaction, after separating the phases and rinsing with cold water)

FIG. 2 shows an example of the effect of time on the zeolite loading step, justifying the adoption of 24 hrs. as standard. Thus, unless otherwise indicated, all experiments were based on a reaction time equal to 24 hrs., which also applied to KOH and $Na_2SiO_3$ pretreatments.

Since water at 373 K is unable to remove strongly bound zeolite particles but diluted HCl was found very capable of doing so, it is clear that the binding mechanism involves participation of surface basic sites. In the presence of water, zeolites will adsorb water molecules in their pore (internal) structure, but they will also do so via their external hydroxyl groups, thereby creating a water envelope around the zeolite particles. Experiments in the absence of water, i.e. using mechanical mixtures of zeolites and treated cellulose fibers, gave no solid evidence for the occurrence of cellulose/zeolite solid/solid reaction pathway. Thus, the presence of adsorbed water to facilitate the binding of zeolite crystallites to cellulose appears to be essential. In all cases, the qualitative features shown in FIG. 2 were observed.

Figure 3:
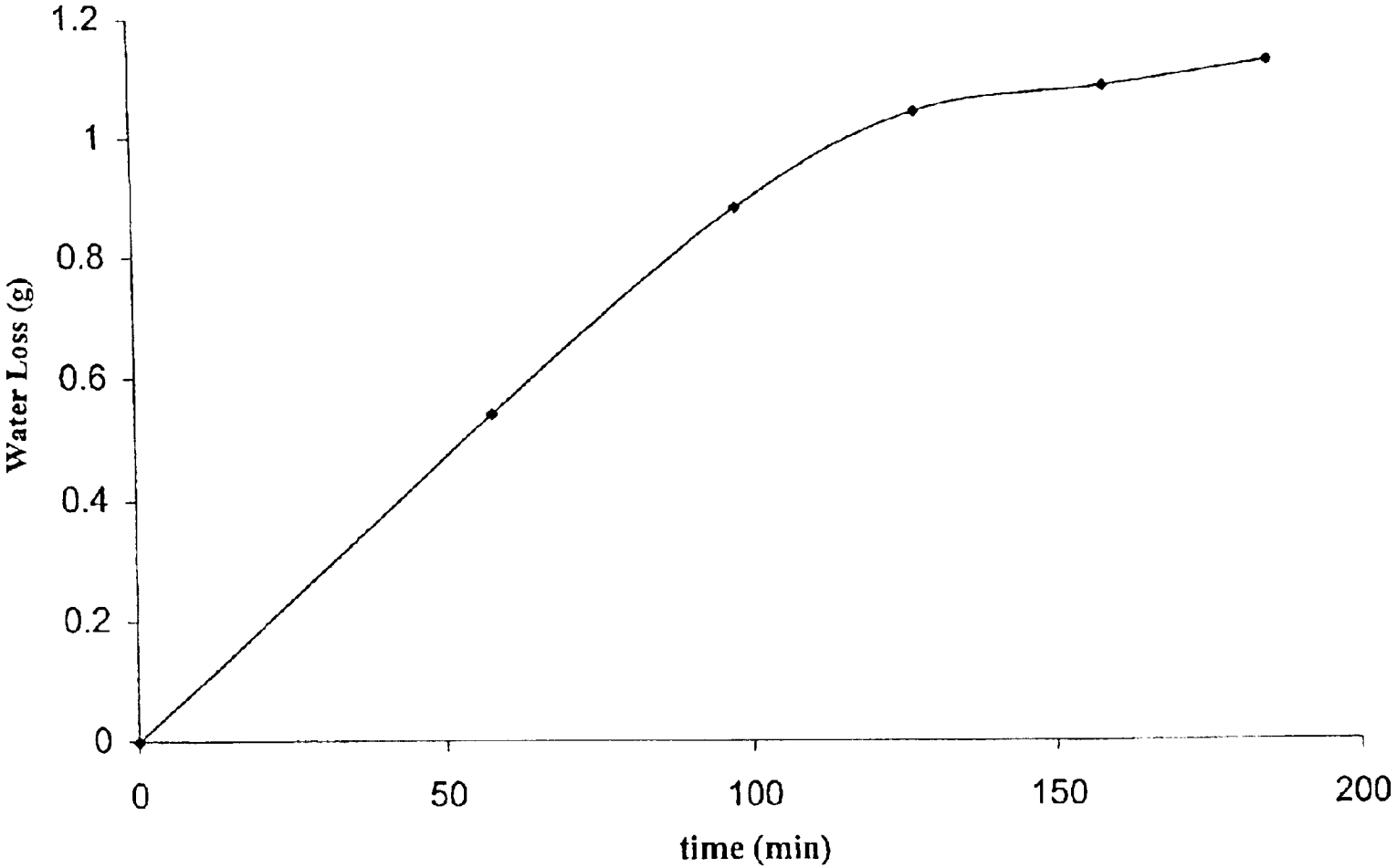
FIG. 3 is a graph showing the water loss profile from the reactor.

It is interesting to note that the closed reactors did not yield good results. It is apparent that timely removal of water from the reaction medium helps the irreversibly adsorbed alkali on the cellulose to activate the zeolite crystallites. Analysis of the amount of water removed from the reactor showed that no more water is released after 190 min. (FIG. 3). The treated cellulose/zeolite/water slurry maintains neutrality throughout the zeolite anchoring process. This indicates that partial dissolution of the zeolite crystallites followed by recrystallization at the cellulose surface is a highly improbable mechanism for composite formation.

Figure 4:
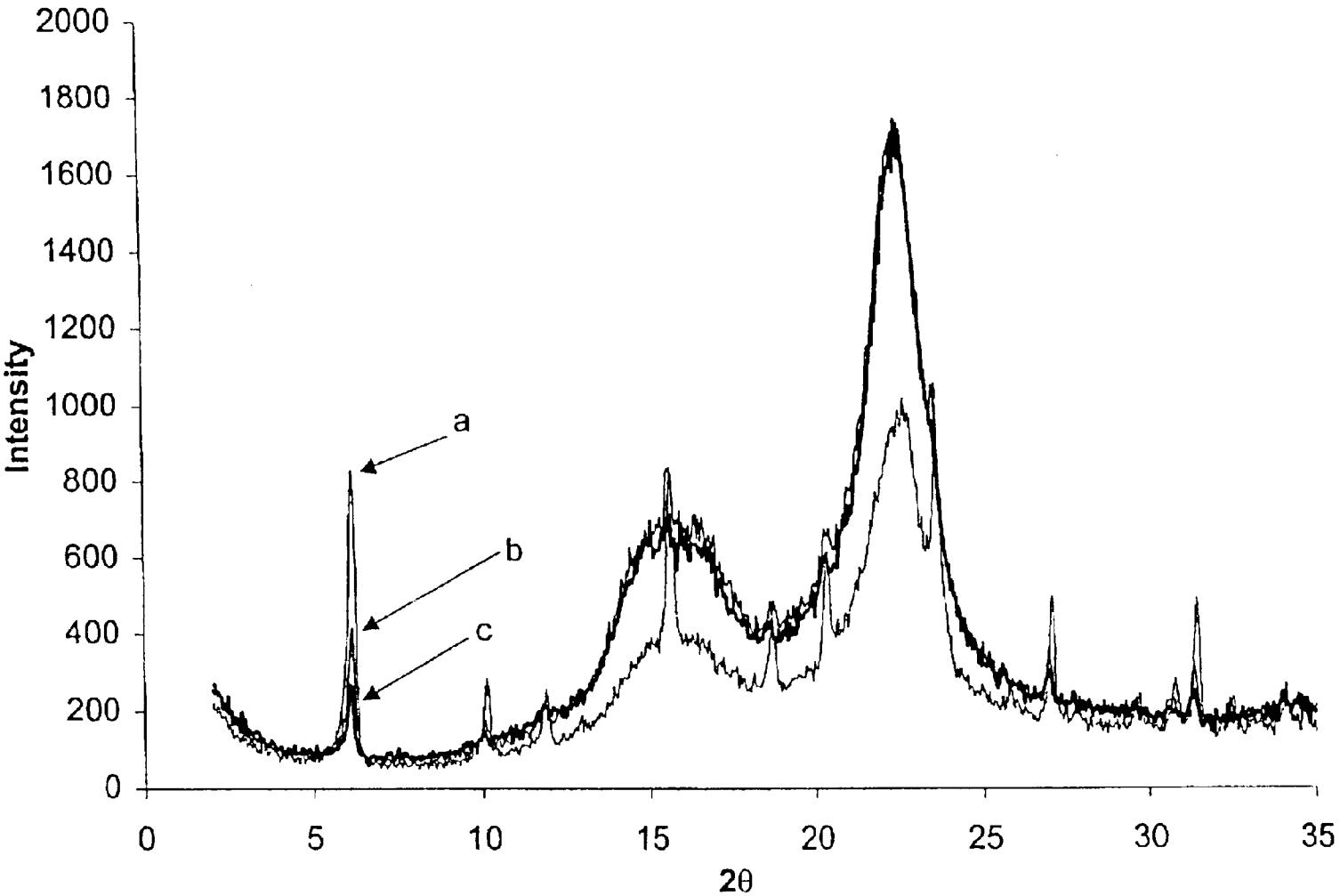
FIG. 4 is a graph showing a) 24 hrs. zeolite Y loading reaction on NaOH-treated fiber, b) same as a), but after hot water (373 K) washing for 2.5 hrs., c) Y-loaded $Na_2SiO_3$-treated fiber after stabilization by 2.5 hrs. hot water washing.

FIG. 4 shows the XRD patterns of as-synthesized zeolite Y-loaded NaOH-Fiber, 2.5 hrs. washed zeolite Y-loaded NaOH-Fiber and 2.5 hrs. washed zeolite Y $Na_2SiO_3$-Fiber. The latter, despite resulting in a lower zeolite loading, still gave positive results. If the relative intensities of the broad cellulose signals (2θ~16° and 23°) are compared to that of the low-angle zeolite Y reflection (2θ~6.2°), it is observed that approximately half the zeolite is removed after the 2.5 hrs. washing cycle with hot water at 373 K. It is clear that the as-synthesized material, i.e. one that has only been thoroughly washed with cold water after synthesis, is not yet satisfactory in light of the adopted stability criterion. However, a) if the zeolite washing process in the presence of boiling water eventually plateaus, and b) if the residual zeolite: cellulose mass ratio is still acceptable, the synthesis of a stable composite should still be possible.

Figure 5:
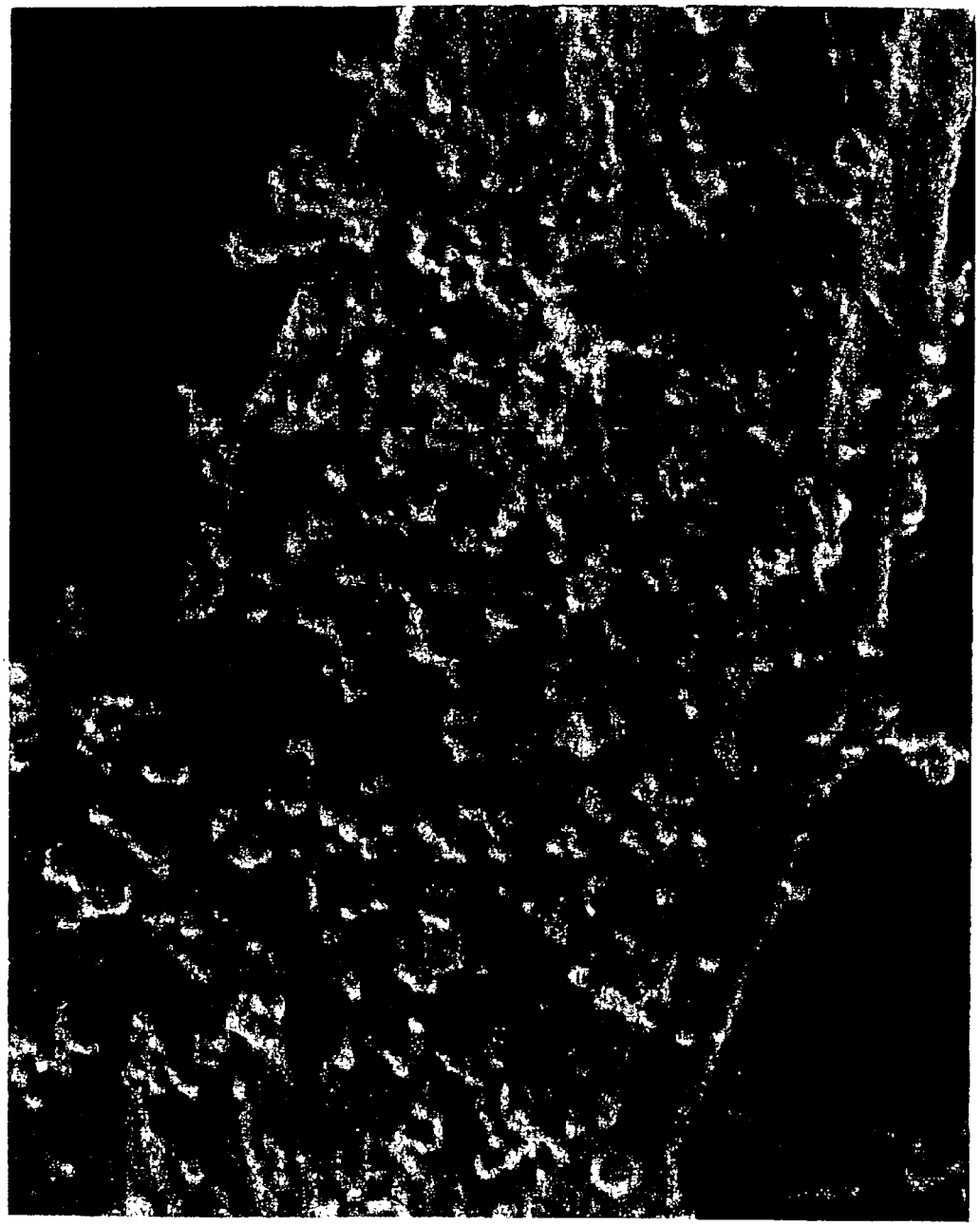
FIG. 5 is an SEM image of zeolite Y-loaded NaOH-Fiber material, after stabilization by hot water washing for 2.5 hrs.

The peak ratio of the zeolite reflection mentioned above and that of cellulose (2θ=16.45°) was always used as a relative measure of the zeolite content on materials washed for different amounts of time. The zeolite: cellulose mass ratios can be inferred from surface area measurements. Emphasis was made on the NaOH-treated cellulose material, rather than on the $Na_2SiO_3$ case, because the latter resulted in smaller zeolite loadings. FIG. 5 is a SEM image of the zeolite Y-loaded NaOH-Fiber material after 2.5 hrs. washing in boiling water. As stated above, KOH pretreatment of the fibers gave better results (ultimately higher zeolite loading) than NaOH treatment for effectively anchoring zeolite L crystallites, which points to these zeolites (Y and L) natural cation preferences. Zeolite L is commercially produced in its potassium form, unlike Y that is generically made from NaOH-based gels.

The effect of temperature was also investigated. The results showed that the NaOH-treated fibers at 353K gave higher zeolite loadings than those conditioned at 373 K. The reaction temperature may also play an important role in the zeolites loading step. Table 1 shows that increasing the reaction temperature did not improve the zeolite loadings. Water removal from the reactor was one of the key variables. Table 1 also shows that lowering the water amount gave better results, but the use of water cannot be eliminated altogether since it is essential for zeolite-fiber binding.

TABLE 1

| | 373K | | | | 383K |
|---|---|---|---|---|---|
| | NaOH-Fiber | | | Blank Fiber | NaOH-Fiber |
| Amount of Water | 1 ml | 2 ml | 3 ml | 1 ml | 2 ml |
| Fresh | 4.1 | 1.9 | 1.5 | 0.63 | 1.2 |
| Washed | 2.1 | 0.85 | .67 | — | 0.51 |

"Washed" refers to the materials exposed to water at 373 K for 2.5 hours.

Figure 6:
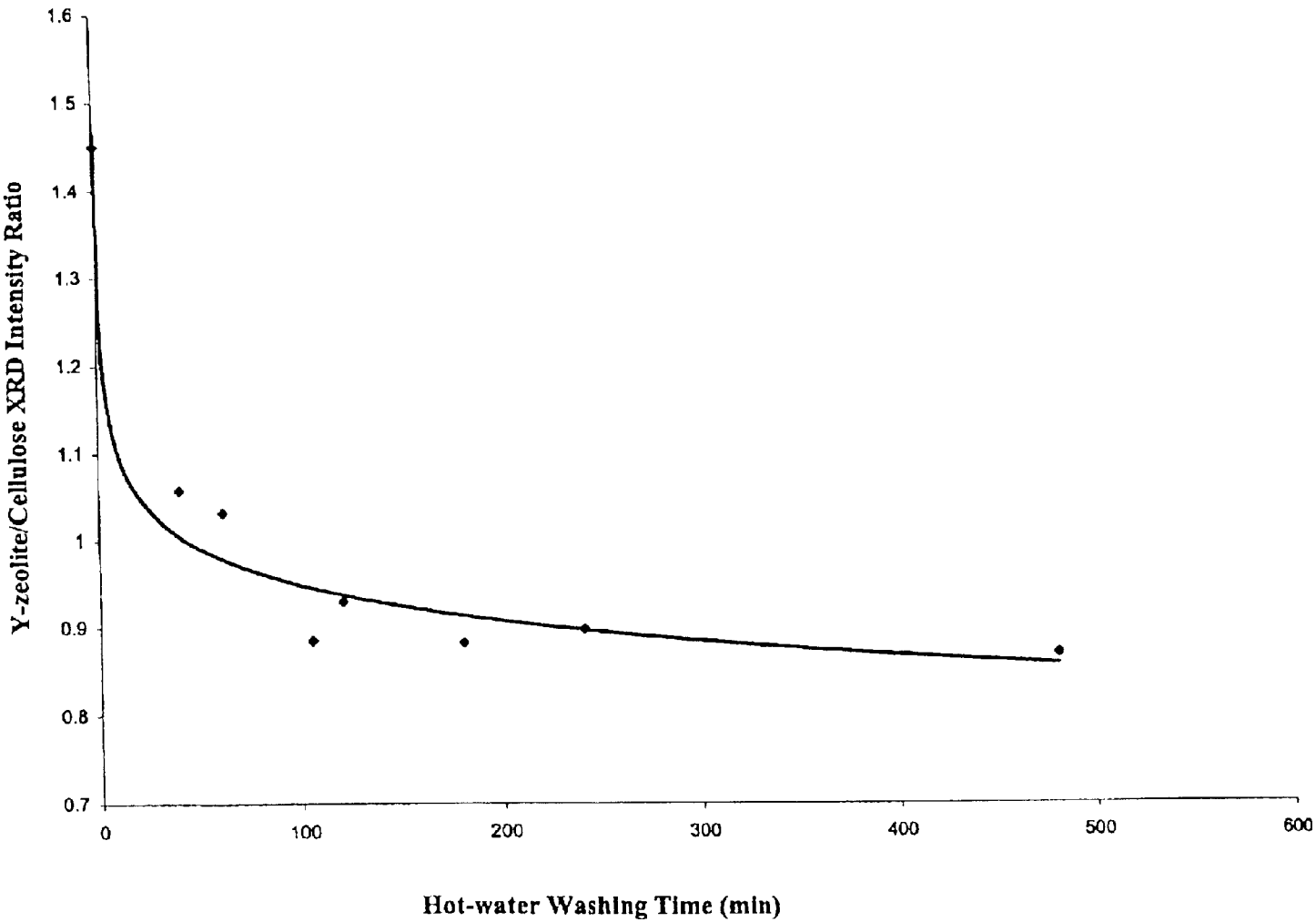
FIG. 6 is a graph showing zeolite Y-to-cellulose XRD reflections ratios as a function of hot water washing time.
Figure 7:
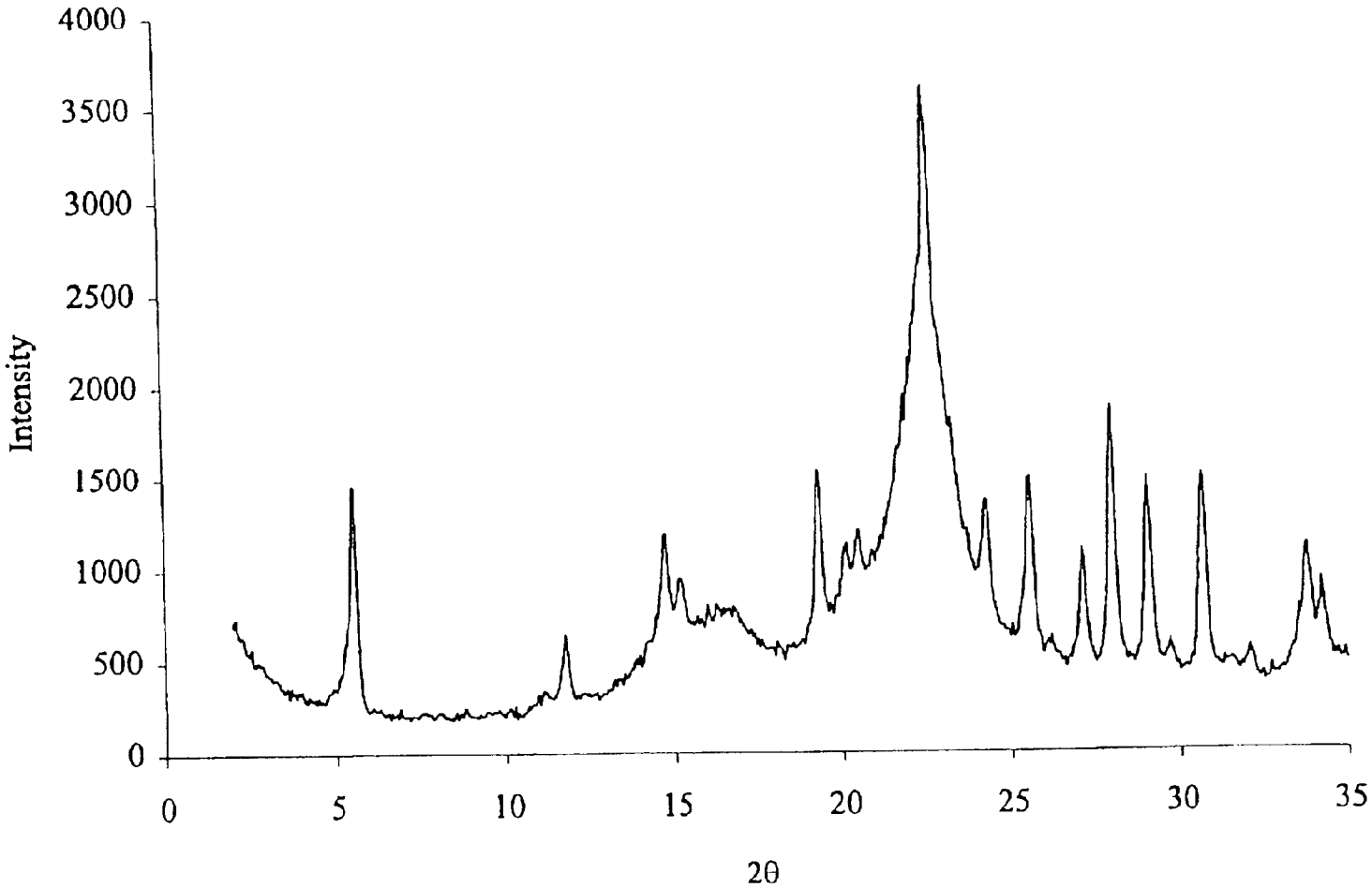
FIG. 7 is a graph showing fresh zeolite L/cellulose composite XRD pattern.
Figure 8:
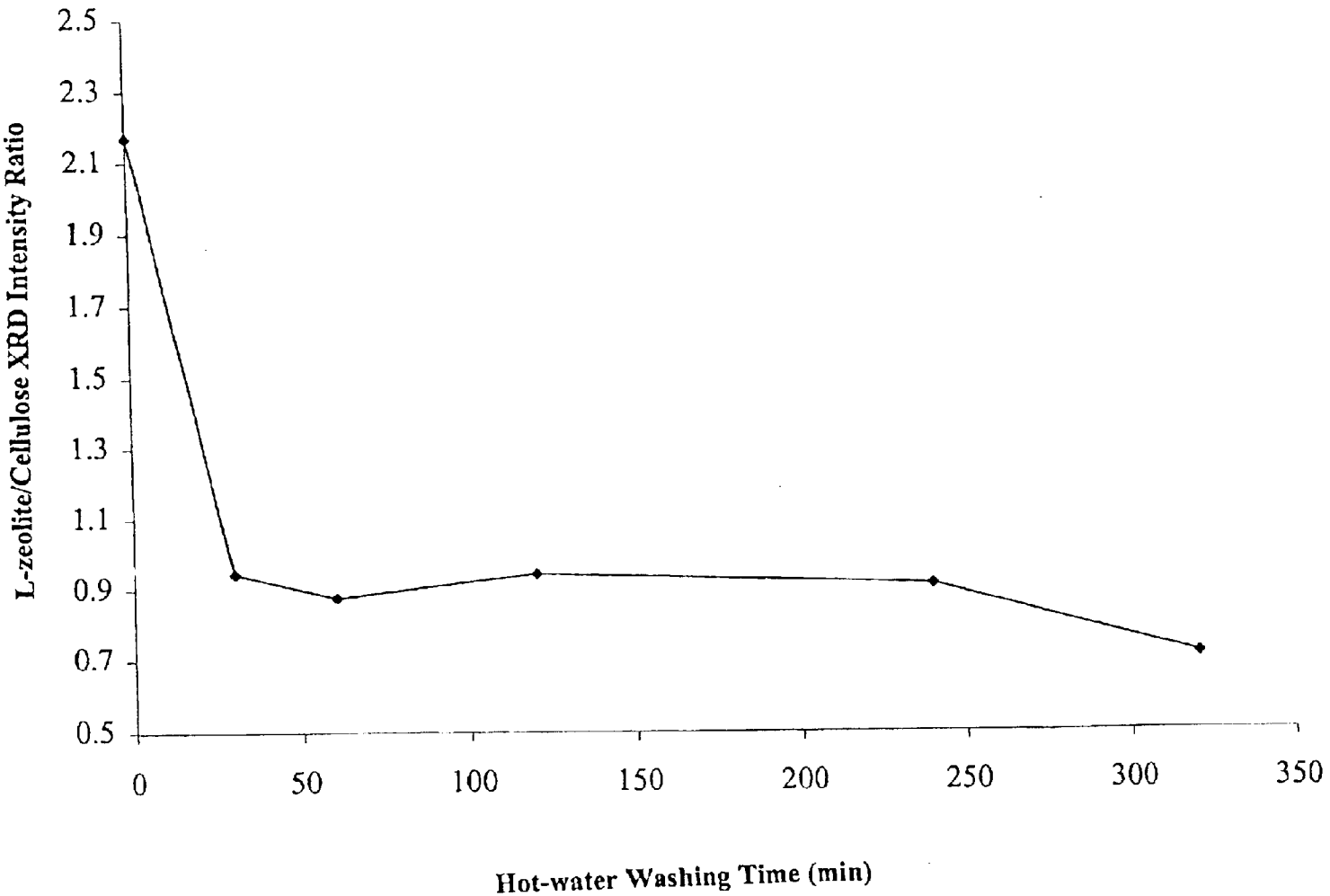
FIG. 8 is a graph showing zeolite L-to-cellulose XRD reflections ratios as a function of hot water washing time.

Analysis of the relative intensities of the zeolite and cellulose XRD signals show that the zeolite content is stabilized after 2.5 hr. hot-water washing (FIG. 6). In addition to a much higher stability toward hot water leaching than with conventional in situ crystallization techniques, an important aspect of the materials produced by the present invention is that the zeolite Y content after prolonged hot-water washing was approximately three times higher than those obtained from extensive in situ crystallization studies done over the same type of cellulose material [K. Niu, supra]. FIG. 7 shows the XRD pattern of as-synthesized zeolite L KOH-treated fibers. After washing in boiling water at 373 K for 30 min., a stable material was obtained (FIG. 8). In all cases, and in accordance with an observation made by Mintova and Valtchev [supra 1995], diluted HCl treatment quantitatively removes the zeolite deposits. Since Y zeolite is known to be stable in dilute HCl, disruption of the cellulose/zeolite interaction rather than dissolution of zeolite crystallites is the expected mechanism for HCl-mediated decomposition of these materials.

Within scattering of data, Table 2 shows how leaching in boiling water affects zeolite loadings until stable values are reached. The table shows BET surface area of zeolite Y and L as a function of washing time in water at 373 K.

TABLE 2

| | BET ($m^2/g$) | | | | | | | |
|---|---|---|---|---|---|---|---|---|
| | Pure | Washed Zeolite-Fiber in hot water in hrs. | | | | | | OH-Treated |
| | Zeolite | 0 | .5 | 1 | 2 | 4 | 8 | Fiber |
| Y | 550 | 246 | 154 | 153 | 118 | 142 | 126 | 30 |
| L | 250 | 75 | 64 | 50 | 56 | 51 | 44 | 26 |

Prolonged washing results in removal of about 50–60% of the zeolite deposits relative to the as-synthesized samples for both L- and Y-based composites. On the assumption that both phases, cellulose and zeolite, contribute to the overall specific surface area (SSA) of the composite independently, one can gain some insight into the issue of mass fractions of each phase from nitrogen adsorption data. Specifically, the simple equation, $SSA_{composite}=X_{zeolite}\ SSA_{zeolite}+(1-X_{zeolite})\ SSA_{cellulose}$, indicates that approximately 18% of the weight in the Y zeolite/NaOH-treated cellulose composite after 8 hrs. washing is effectively Y zeolite, while 8 wt. % is the zeolite loading in the 8-hr. washed L-zeolite/KOH-treated cellulose material.

Thus, pretreatment of natural, low-lignin cellulose fibers with alkali provides a simple route for anchoring preformed zeolite crystallites onto the cellulose surface. In light of stability data of these composites in water at 373 K, L- and Y-loaded cellulose materials resistant toward leaching of the zeolite phase in aqueous media can be prepared by exposing as-synthesized samples to boiling water for several hours. Typical zeolite loadings in stable composites fall in the 5–20% range.

In view of the above, it will be seen that the several objects of the invention are achieved and other advantageous results attained.

As various changes could be made in the above methods and products without departing from the scope of the invention, it is intended that all matter contained in the above description and shown in the accompanying drawings shall be interpreted as illustrative and not in a limiting sense.

What is claimed is:

1. The method of preparing stable cellulosic fiber material for use in forming zeolite/cellulose composites comprising the steps of:

(a) suspending loose cellulose fibers in an aqueous solution of a compound selected from the group consisting of alkali metal and alkaline earth metal hydroxides and silicates;

(b) stirring the resulting suspension until it reaches a macroscopically homogeneous appearance;

(c) heating the resulting mixture at a temperature of approximately 323–423 K until only dry solids remain;

(d) contacting the resulting mixture with excess distilled water to remove physically adsorbed or trapped compound of step (a) from said fibers; and (e) heating the resulting fiber material at a temperature of approximately 323–423 K to dry said fiber material.

2. The method as set forth in claim 1, wherein the loose cellulose fibers used in step (a) have a lignin content of not more than approximately 0.1%.

3. The method as set forth in claim 1, wherein said compound in step (a) is sodium hydroxide.

4. The method as set forth in claim 1, wherein said compound in step (a) is potassium hydroxide.

5. The method as set forth in claim 1, wherein said compound in step (a) is sodium silicate.

6. The method as set forth in claim 1, wherein said heating steps (c) and (e) are carried out at a temperature of approximately 373 K.

* * * * *